United States Patent [19]

Ikeda et al.

[11] Patent Number: 4,918,047

[45] Date of Patent: Apr. 17, 1990

[54] HEAT-SENSITIVE RECORDING MATERIAL

[75] Inventors: Kensuke Ikeda; Ken Iwakura; Masato Satomura, all of Shizuoka, Japan

[73] Assignee: Fuji Photo Film Co., Ltd., Kanagawa, Japan

[21] Appl. No.: 294,952

[22] Filed: Jan. 6, 1989

Related U.S. Application Data

[63] Continuation of Ser. No. 74,119, Jul. 16, 1987, abandoned.

[30] Foreign Application Priority Data

| | | | |
|---|---|---|---|
| Jul. 16, 1986 | [JP] | Japan | 61-167646 |
| Jul. 23, 1986 | [JP] | Japan | 61-173171 |
| Oct. 14, 1986 | [JP] | Japan | 61-243823 |
| Oct. 14, 1986 | [JP] | Japan | 61-243824 |
| Oct. 14, 1986 | [JP] | Japan | 61-243825 |

[51] Int. Cl.[4] ..... B41M 5/18

[52] U.S. Cl. ..... 503/216; 427/150; 428/913; 503/212; 503/225

[58] Field of Search ..... 427/150; 428/913, 914; 503/209, 212, 216, 217, 225

[56] References Cited

U.S. PATENT DOCUMENTS

| | | | |
|---|---|---|---|
| 3,864,146 | 2/1975 | Oda et al. | 503/212 |
| 3,983,292 | 9/1976 | Saito et al. | 503/212 |
| 4,134,847 | 1/1979 | Oda et al. | 503/216 |
| 4,228,222 | 10/1980 | Murakami et al. | 428/500 |
| 4,234,212 | 11/1980 | Kato et al. | 503/216 |
| 4,236,732 | 12/1980 | Murakami et al. | 503/212 |
| 4,289,332 | 9/1981 | Kato | 503/216 |
| 4,514,745 | 4/1985 | Suzuki et al. | 346/216 |

FOREIGN PATENT DOCUMENTS

| | | | |
|---|---|---|---|
| 0219302 | 4/1987 | European Pat. Off. | 503/212 |
| 2367618 | 5/1978 | France | 503/212 |
| 2421410 | 10/1979 | France | 503/212 |

*Primary Examiner*—Bruce H. Hess

*Attorney, Agent, or Firm*—Sughrue, Mion, Zinn, Macpeak & Seas

[57] ABSTRACT

A heat-sensitive recording material comprising a support having thereon a recording layer containing an electron-donating colorless dye and an electron-accepting compound, wherein the electron-accepting compound is selected from salicylic acid derivatives having an acyl group, a substituted amino group, an aryloxymethyl group, an alkoxy group or an aryloxy group, or metal salts thereof, and hydroxynaphthoic acid derivatives having an alkyloxy group or metal salts thereof, the recording layer further containing a metal compound in an amount of from about 0.05 to about 10 mols per mol of the electron-accepting compound.

8 Claims, No Drawings

HEAT-SENSITIVE RECORDING MATERIAL

This application is a continuation-in-part application based on application Ser. No. 07/074,119 filed July 16, 1987 now abandoned.

FIELD OF THE INVENTION

The present invention relates to a heat-sensitive recording material utilizing a color formation reaction between an electron-donating colorless dye and an electron-accepting compound, and more particularly, to a recording material providing a color image having improved color developability, preservability before recording, and image stability.

BACKGROUND OF THE INVENTION

Recording materials employing a combination of an electron-donating colorless dye (hereinafter referred to as a color former) and an electron-accepting compound (hereinafter referred to as a color developer) are well known, and include pressure-sensitive papers, heat-sensitive papers, light- and pressure-sensitive papers, electric heat-sensitive papers, heat-sensitive transfer papers, and the like. The details of these types of recording materials are described, e.g., in British Pat. No. 2,140,449, U.S. Pat. Nos. 4,480,052 and 4,436,920, Japanese Patent Publication No. 23922/85, U.S. patent application Ser. No. 916,430 (filed on Oct. 7, 1986), and Japanese Patent Application (OPI) Nos. 179836/82, 123556/85, and 123557/85 (the term "OPI" as used herein refers to a "published unexamined Japanese patent application").

These recording materials employing a color former and a color developer are required (1) to provide an image having sufficient color density with sufficient color formation sensitivity, (2) to be free from the formation of fog, (3) to provide an image having sufficient fastness, (4) to form a hue suitable for copying machines, (5) to have a high S/N ratio, (6) to provide a developed image sufficiently resistant to chemicals, and the like. However, none of the above-mentioned various types of conventional recording materials has completely fulfilled these requirements.

In particular, heat-sensitive recording materials, which have recently undergone remarkable development, have the specific disadvantages in that fog may form on contact with solvents, etc., and discoloration of a developed image may occur due to contact with fats and oils, chemicals, etc. Namely, contact with stationery and office supplies, such as aqueous ink pens, oily ink pens, fluorescent pens, stamping inks, adhesives, paste adhesives, diazo developers, etc., or cosmetics, such as hand creams, emulsions, etc., causes color formation on the white background (fog) or discoloration of a developed color image, resulting in significant impairment of commercial value. Moreover, with the recent increase in demand for heat-sensitive recording materials as POS labels, it has keenly been demanded to develop heat-sensitive recording materials having high chemical resistance.

The present invention has resulted from detailed investigations on each of color formers and color developers, paying particular attention to solubility in oil or water, partition coefficient, pKa, polarity of substituents, position of substituents, change in crystallizability and solubility when used in combination, and the like.

SUMMARY OF THE INVENTION

One object of the present invention is to provide a heat-sensitive recording material having satisfactory color developability, preservability before recording, and developed image stability, while satisfying other practical requirements for recording materials.

It has now been found that the above and other objects of the present invention can be accomplished by a heat-sensitive recording material utilizing a color formation reaction between an electron-donating colorless dye (color former) and an electron-accepting compound (color developer) in a heat-sensitive recording layer, wherein the color developer is selected from salicylic acid derivatives having an acyl group, a substituted amino group, an aryloxymethyl group, an alkoxy group or an aryloxy group, or metal salts thereof, and hydroxynaphthoic acid derivatives having an alkyloxy group or metal salts thereof, and the recording layer contains a metal compound in an amount of from about 0.05 to about 10 mols per mol of the electron-accepting compound.

The recording materials using at least one of the above-described color developer compounds in combination with a metal compound according to the present invention are capable of forming color images having sufficient color density and marked stability against discoloration due to long-term exposure to light, heat or moisture. Further, recording materials employing these color developers are free from the formation of fog due to contact with solvents or discoloration due to fats, oils or chemicals.

DETAILED DESCRIPTION OF THE INVENTION

The electron-accepting compound used in the present invention may be represented by formulae (I) or (II):

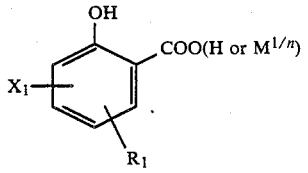

(I)

wherein $R_1$ represents a substituted or unsubstituted acyl group, a substituted amino group, a substituted or unsubstituted aryloxymethyl group, a substituted or unsubstituted alkoxy group, or a substituted or unsubstituted aryloxy group; $X_1$ represents a hydrogen atom, an alkyl group, an alkoxy group, a phenyl group or a halogen atom; and M represents an n-valent metal atom, wherein n represents an integer of from 1 to 3;

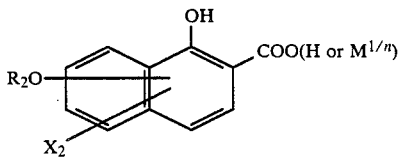

(II)

wherein M is as defined above in formula (I); $R_2$ represents a substituted or unsubstituted alkyl group; and $X_2$ represents a hydrogen atom, an acyl group, an alkyl group, an alkoxy group or a halogen atom.

The acyl- or (substituted amino)-substituted salicylic acid derivatives or metal salts thereof are preferably represented by formula (III):

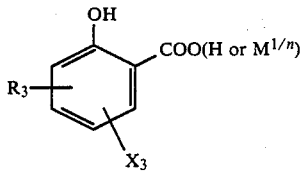

(III)

wherein $R_3$ represents a substituted or unsubstituted acyl group or a substituted aminogroup; $X_3$ represents a hydrogen atom, an alkyl group, an alkoxy group, a phenyl group or a halogen atom; and M represents an n-valent metal atom, wherein n represents an integer of from 1 to 3.

The aryloxymethyl-substituted salicylic acid derivatives or metal salts thereof are preferably represented by formula (IV):

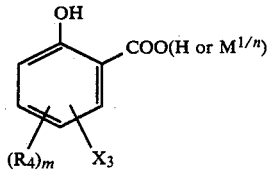

(IV)

wherein $X_3$ and M are as defined above in formula (III); $R_4$ represents a substituted or unsubstituted aryloxymethyl group; and m represents an integer of 1 or 2.

The alkoxy- or aryloxy-substituted salicylic acid derivatives or metal salts thereof are preferably represented by formula (V):

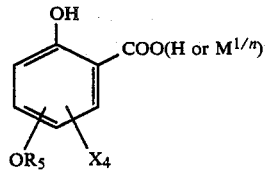

(V)

wherein M is as defined above in formula (III); $R_5$ represents a substituted or unsubstituted alkyl group or a substituted or unsubstituted aryl group; and $X_4$ represents a hydrogen atom, an alkyl group, an alkoxy group, a phenyl group or a halogen atom.

The hydroxynaphthoic acid derivatives or metal salts thereof are preferably represented by formula (VI):

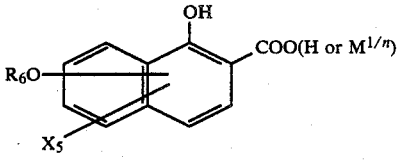

(VI)

wherein M is as defined above in formula (III); $R_6$ represents a substituted or unsubstituted alkyl group; $X_5$ represents a hydrogen atom, an acyl group, an alkyl group, an alkoxy group or a halogen atom.

In formula (III), the acyl group represented by $R_3$ preferably includes an aliphatic or aromatic acyl group having from 2 to 18 carbon atoms, and more preferably from 2 to 13 carbon atoms. Suitable substituents for the acyl group preferably include an alkyl group, an alkoxy group, an aryl group, an aryloxy group, and a halogen atom. Specific examples of the acyl group include an acetyl group, a propionyl group, a butyryl group, an isobutyryl group, a valeryl group, a lauroyl group, a myristoyl group, an acryloyl group, a methacryloyl group, a benzoyl group, a toluoyl group, a naphthoyl group, a chlorobenzoyl group, a methoxybenzoyl group, a hexanoyl group, a heptanoyl group, a decanoyl group, a phenoxyacetyl group, a phenylacetyl group, a naphthyloxyacetyl group, etc.

The substituted amino group represented by $R_3$ in formula (III) preferably includes an acylamino group, an arylsulfonylamino group, an alkylaminocarbonylamino group, an arylaminocarbonylamino group, a dialkylamino group, and an alkylarylamino group, each of which may have from 2 to 18 carbon atoms.

In formulae (III) and (IV), $X_3$ preferably represents a hydrogen atom, an alkyl group having from 1 to 18 carbon atoms, an alkoxy group having from 1 to 20 carbon atoms, a phenyl group, a chlorine atom or a fluorine atom.

M in formulae (III), (IV), (V) and (VI) preferably represents a hydrogen atom, zinc, aluminum, magnesium or calcium.

Specific but non-limiting examples of the compounds represented by formula (III) wherein $R_3$ is an acyl group are 5-heptanoylsalicylic acid, 5-decanoylsalicylic acid, 5-lauroylsalicylic acid, 5-benzoyl salicylic acid, 5-toluoylsalicylic acid, 5-phenoxyacetylsalicylic acid, 5-phenylacetylsalicylic acid, 3-methyl-5-benzoylsalicylic acid, 3-methyl-5-phenylacetylsilicylic acid, 3-methyl-5-phenoxyacetylsalicylic acid, and metal salts thereof. These salicylic acid derivatives may be used either individually or in combination.

Specific but non-limiting examples of the compounds represented by formula (III) wherein $R_3$ is a substituted amino group are 4-myristoylaminosalicylic acid, 4-decanoylaminosalicylic acid, 4-phenylacetylaminosalicylic acid, 4-phenoxyacetylaminosalicylic acid, 4-benzoylaminosalicylic acid, 4-toluoylaminosalicylic acid, 4-N-stearylcarbamoylaminosalicylic acid, 4-N-phenylcarbamoylaminosalicylic acid, 4-p-toluenesulfonylaminosalicylic acid, 4-dibenzylaminosalicylic acid, 5-myristoylaminosalicylic acid, 4-phenylacetylaminosalicylic acid, and metal salts thereof. These salicylic acid derivatives may be used either individually or in combination.

In formula (IV), the aryloxymethyl group represented by $R_4$ preferably contains from 7 to 18 carbon atoms, and more preferably from 7 to 16 carbon atoms. m preferably represents 1 or 2.

Specific examples of the aryloxymethyl group include a phenoxymethyl group, a tolyloxymethyl group, an ethylphenoxymethyl group, a propylphenoxymethyl group, a butylphenoxymethyl group, an octylphenoxymethyl group, a nonylphenoxymethyl group, a phenylphenoxymethyl group, a cumylphenoxymethyl group, a naphthyloxymethyl group, a chlorophenoxymethyl group, a dimethylphenoxymethyl group, a p-methoxyphenoxymethyl group, a p-ethoxyphenoxymethyl group, etc.

Specific but non-limiting examples of the compounds represented by formula (IV) are 5-tolyloxymethylsalicylic acid, 5-butylphenoxymethylsalicylic acid, 5-p-methoxyphenoxymethylsalicylic acid, 5-cumylphenoxymethylsalicylic acid, 5-phenylphenoxymethylsalicylic acid, 3-methyl-5-tolyloxymethylsalicylic acid, 3-methyl-5-ethylphenoxymethylsalicylic acid, 3-methyl-5-methoxyphenoxymethylsalicylic acid, 3-methyl-5-naphthyloxymethylsalicylic acid, 3-methyl-5-cumylphenoxymethylsalicylic acid, 3,5-bisphenoxymethylsalicylic acid, 3,5bistolyloxymethylsalicylic acid, 3,5-bisethylphenoxymethylsalicylic acid, 3,5-bispropylphenoxymethylsalicylic acid, 3,5-bisoctylphenoxymethylsalicylic acid, 3,5-bisphenylphenoxymethylsalicylic acid, 3,5-biscumylphenoxymethylsalicylic acid, 3,5-bischlorophenoxymethylsalicylic acid, 3,5-bismethoxyphenoxymethylsalicylic acid, 3,5-bisdimethylphenoymethylsalicylic acid, 3,5-bisethoxyphenoxymethylalicylic acid, and metal salts thereof. These salicylic acid derivatives may be used individually or in combination.

In formula (V), the alkyl group represented by $R_5$ may be saturated or unsaturated and cyclic or acyclic. Suitable substituents for the alkyl group include an aryl group, an alkoxy group, an aryloxy group, a halogen atom, an acylamino group, an aminocarbonyl group, a cyano group, etc.

The aryl group as represented by $R_5$ includes a phenyl group, a naphthyl group, and a heterocyclic group. Substituents for the aryl group include an alkyl group, an alkoxy group, an aryloxy group, a halogen atom, a nitro group, a cyano group, a substituted carbamoyl group, a substituted sulfamoyl group, a substituted amino group, a substituted oxycarbonyl group, a substituted oxysulfonyl group, a thioalkoxy group, an arylsulfonyl group, a phenyl group, etc.

$R_5$ preferably represents an alkyl group having from 1 to 30 carbon atoms or an aryl group having from 6 to 24 carbon atoms.

$X_4$ preferably represents a hydrogen atom, an alkyl group having from 1 to 9 carbon atoms, an alkoxy group having from 1 to 5 carbon atoms, a chlorine atom or a fluorine atom.

The preferred substituents for the alkyl group are an aryl group, an alkoxy group, a halogen atom, an aryloxy group, and an acylamino group.

The preferred substituents for the aryl group are an alkyl group, an alkoxy group, a halogen atom, a phenyl group, and a substituted carbamoyl group, with an aryloxyalkyl group being particularly preferred. In this case, the more preferred $R_5$ is represented by $-(C_pH_{2p}-O)_q-Ar$, wherein Ar represents a substituted or unsubstituted aryl group, preferably having from 6 to 22 carbon atoms; p represents an integer of from 1 to 10, and preferably from.2 to 4; and q represents an integer of from 1 to 3, and preferably 1 or 2.

The aryl group represented by Ar may have one or more substituents selected from an alkyl group having from 1 to 12 carbon atoms, an aralkyl group having from 7 to 16 carbon atoms, an alkoxy group having from 1 to 12 carbon atoms, a halogen atom, a phenyl group, an alkoxycarbonyl group, etc.

Preferred examples of the aryl group represented by Ar include a phenyl group, a tolyl group, an ethylphenyl group, a propylphenyl group, a butylphenyl group, a cyclohexyl group, an octylphenyl group, a nonylphenyl group, a dodecylphenyl group, a benzylphenyl group, a phenethylphenyl group, a cumylphenyl group, a xylyl group, a diphenethylphenyl group, a methoxyphenyl group, an ethoxyphenyl, group, a benzyloxyphenyl group, an octyloxyphenyl group, a dodecyloxyphenyl group, a chlorophenyl group, a fluorophenyl group, a phenylphenyl group, a hexyloxycarbonylphenyl group, a benzyloxycarbonylphenyl group, a dodecyloxycarbonylphenyl group, a naphthyl group, a methylnaphthyl group, a chloronaphthyl group, etc.

The substituent $OR_5$ in formula (V) is preferably bonded to the para-position with respect to the carboxyl group.

The salicylic acid derivatives represented by formula (V) preferably contain 13 or more total carbon atoms, and more preferably contain 16 or more total carbon atoms, from the standpoint of ensuring water insolubility.

Specific but non-limiting examples of the compounds of formula (V) are 4-hexyloxysalicylic acid, 4-cyclohexyloxysalicylic acid, 4-octyloxysalicylic acid, 4-decyloxysalicylic acid, 4-dodecyloxysalicylic acid, 4-tetradecyloxysalicylic acid, 4-pentadecyloxysalicylic acid, 4-hexadecyloxysalicylic acid, 4-octadecyloxysalicylic acid, 4-eicosyloxysalicylic acid, 4-triacontyloxysalicylic acid, 4-oleyloxysalicylic acid, 4-β-phenethyloxysalicylic acid, 4-β-dodecyloxyethoxysalicylic acid, 4-(12-chlorododecyl)oxysalicylic acid, 4-β-N-stearoylaminoethoxysalicylic acid, 4-β-N-myristoylaminoethoxysalicylic acid, 4-β-perfluorohexylethoxysalicylic acid, 4-dodecyloxy-5-chlorosalicylic acid, 4-dodecyloxy-5-methylsalicylic acid, 4-dodecyloxy-6-methylsalicylic acid, 4-dodecyloxy-6-phenylsalicylic acid, 4-methoxy-6-dodecyloxysalicylic acid, 6-octadecyloxysalicylic acid, 4-p-t-octylphenyloxysalicylic acid, 4-p-dodecyloxyphenyloxysalicyclic acid, 4-p-chlorophenoxy-6-butylsalicylic acid, 4-p-phenylphenoxysalicylic acid, 4-p-N-myristoylcarbamoylphenyloxysalicylic acid, 4-benzyloxy-6-dodecyloxysalicyclic acid, 4-β-phenoxyethoxysalicylic acid, 4-(4-phenoxybutoxy)salicylic acid, 4-(6-phenoxyhexyloxy)salicylic acid, 4-(5-phenoxyamyloxy)salicylic acid, 4-(8-phenoxyoctyloxy)salicylic acid, 4-(10-phenoxydecyloxy) salicylic acid, 4-β-p-tolyloxyethoxysalicylic acid, 4-β-m-tolyloxyethoxysalicylic acid, 4-β-p-ethylphenoxyethoxysalicyclic acid, 4-β-p-isopropylphenoxyethoxysalicylic acid, 4-β-p-t-butylphenoxyethoxysalicylic acid, 4-β-p-cyclohexylphenoxyethoxysalicylic acid, 4-β-p-t-octylphenoxyethoxysalicylic acid, 4-β-pnonylphenoxyethoxysalicylic acid, 4-β-p-dodecylphenoxyethoxysalicylic acid, 4-β-p-benzylphenoxyethoxysalicylic acid, 4-(2-p-α-phenethylphenoxyethoxy)salicylic acid, 4-β-o-methoxyphenoxyethoxysalicylic acid, 4-β-p-cumyloxyethoxysalicylic acid, 4-β-(2,4-dimethylphenoxy)ethoxysalicylic acid, 4-β-(3,4-dimethylphenoxy)ethoxysalicylic acid, 4-β-(3,5-dimethylphenoxy)ethoxysalicylic acid, 4-β-(2,4-bis-α-phenethylphenoxy)ethoxysalicylic acid, 4-β-p-methoxyphenoxyethoxysalicylic acid, 4-β-ethoxyphenoxyethoxysalicyclic acid, 4-β-p-benzyloxyphenoxyethoxysalicylic acid, 4-β-p-dodecyloxyphenoxyethoxysalicylic acid, 4-β-p-chlorophenoxyethoxysalicylic acid, 4-β-p-phenylphenoxyethoxysalicylic acid, 4-β-p-cyclohexylphenoxyethoxysalicylic acid, 4-β-p-benzyloxycarbonylphenoxyethoxysalicylic acid, 4-β-p-dodecyloxycarbonylphenoxyethoxysalicyclic acid, 4-β-naphthyl(2)-oxyethoxysalicylic acid, 5-β-p-ethylphenoxyethoxysalicylic acid, 4-β-phenoxyethoxy-6-methylsalicylic acid, 4-β-phenoxyethoxy-6-chlorosalicylic acid, 4-β-phenoxyisopropyloxysalicylic acid, 4-ω-p-methoxyphenoxy-3-oxa-n-pentyloxysalicyclic acid, etc. These salicylic acid derivatives may be used either individually or in combination.

In formula (VI), the alkyl group represented by $R_6$ may be saturated or unsaturated and cyclic or acyclic. Suitable substituents for the alkyl group include an aryl group, an alkoxy group, an aryloxy group, a halogen atom, an acylamino group, an aminocarbonyl group, a cyano group, an alkoxycarbonyl group, etc. Of these substituents, suitable aryl groups include a phenyl group, a naphthyl group, and a heterocyclic group, which may further be substituted with an alkyl group, an alkoxy group, an aryloxy group, a halogen atom, a nitro group, a cyano group, a substituted carbamoyl group, a substituted sulfamoyl group, a substituted amino group, a substituted oxycarbonyl group, a substituted oxysulfonyl group, a thioalkoxy group, an arylsulfonyl group, a phenyl group, etc., if desired.

$R_6$ preferably represents an alkyl group having from 1 to 22 carbon atoms. $X_5$ preferably represents a hydrogen atom, an alkyl group having from 1 to 9 carbon atoms, an alkoxy group having from 1 to 5 carbon atoms, a chlorine atom or a fluorine atom. Preferred substituents for the alkyl group represented by $R_6$ are an aryl group having from 6 to 12 carbon atoms, an aryloxy group having from 6 to 16 carbon atoms, an alkoxy group having from 1 to 12 carbon atoms, a halogen atom, and an alkoxycarbonyl group.

The naphthoic acid derivatives of formula (VI) preferably contain 14 or more total carbon atoms, and more preferably 16 or more total carbon atoms, from the standpoint of ensuring water insolubility.

Specific but non-limiting examples of the compounds of formula (VI) include 1-hydroxy-4-benzyloxy-2-naphthoic acid, 1-hydroxy-4-dodecyloxy-2-naphthoic acid, 1-hydroxy-4-octadecyloxy-2-naphthoic acid, 1-hydroxy-4-β-phenoxyethoxynaphthoic acid, 1-hydroxy-4-β-p-tolyloxyethoxy-2-naphthoic acid, 1-hydroxy-5-benzyloxy-2-naphthoic acid, 1-hydroxy-5-dodecyloxynaphthoic acid, 2-hydroxy-5-benzyloxy-3-naphthoic acid, and zinc, aluminum or calcium salts thereof. These naphthoic acid derivatives may be usedeither individually or in combination.

Suitable metal compounds to be used in combination with the color developers described above include an oxide, a hydroxide, a sulfide, a carbonate, a phosphate, a silicate, a halide, a halide complex salt, a sulfate, a nitrate, etc., of a metal selected from divalent or trivalent metals, such as zinc, magnesium, barium, calcium, aluminum, tin, titanium, nickel, cobalt, manganese, and iron, with zinc compounds being particularly preferred.

Specific examples of such metal compounds are zinc oxide, zinc hydroxide, zinc aluminate, zinc sulfide, zinc carbonate, zinc phosphate, zinc silicate, zinc cyanide, zinc hexacyanoferrate, aluminum oxide, magnesium oxide, titanium oxide, aluminum hydroxide, aluminum silicate, and the like. Preferred among these metal compounds are sparingly water-soluble compounds, and more preferred are sparingly water-soluble zinc compounds.

The amount of the metal compound to be used preferably ranges from about 0.05 to about 10 mols, and more preferably from 0.10 to 8 mols, per mol of the color developer.

The mode of addition of these metal compounds is not particularly restricted. It is desirable that the color developer and the metal compound be dispersed in an aqueous medium by means of a ball mill, a sand mill, etc., or a mixture of the salicylic acid derivative and the metal compound be mixed and ground in a dry grinder, e.g., a jet mill, and then dispersed in a Kedy mill, a dissolver, etc. It is particularly preferred that at least about 80% by weight of the metal compound to be added to a recording layer be mixed and dispersed with the salicylic acid derivative in the manner as described above.

The dispersion of the color developer and the metal compound is preferably maintained in an alkaline condition, i.e., at a pH of about 7.0 or higher, throughout the dispersion step. To this effect, sodium hydroxide, aqueous ammonia or the like may be added to the system in an amount sufficient to effect the desired pH adjustment. For ensuring color formation sensitivity, dispersion of the mixture in a sand mill, etc., is preferably carried out until the dispersed particles have a particle size of about 3 μm or less, and more preferably 2 μm or less. Further, in order to facilitate size reduction and to manifest the effect of the metal compound addition, the particle size of the metal compound to be mixed and dispersed is preferably as small as possible, usually 2 μm or smaller. In particular, metal oxides which are obtained by the reducing calcination of a mineral and combustion oxidation of the resulting gaseous metal with air, such as zinc oxide, are preferred because of their very small particle size.

The heat-sensitive recording materials comprising at least one of the above-described color developers and metal compounds according to the present invention provide color images exhibiting sufficient color density, marked stability, and substantial freedom from discoloration even when exposed to light, heat or moisture for an extended period of time and are, therefore, particularly advantageous in terms of long-term preservability of recorded images. In addition, the heat-sensitive recording materials according to the present invention are free from disadvantages often encountered with conventional heat-sensitive recording materials, such as fog generation on the white background due to solvents, etc., or discoloration of the color images due to contact with fats, oils, chemicals, etc.

If desired, the color developers according to the present invention may be used in combination with one or more known color developers, such as salicylic acid derivatives other than as described above in formulae (I) to (VI), phenol derivatives, phenolic resins, acid clay, and the like. Such known color developers include phenol derivatives, e.g., 4-t-butylphenol, 4-phenylphenol, 4-hydroxydiphenoxide, α-naphthol, β-naphthol, hexyl 4-hydroxybenzoate, 2,2'-dihydroxybiphenyl, 2,2'-bis(4-hydroxyphenyl)propane (bisphenol A), 4,4'-isopropylidenebis(2-methylphenol), 1,1'-bis(3-chloro-4-hydroxyphenyl) cyclohexane, 1,1-bis(3-chloro-4-hydroxyphenyl)-2-ethylbutane, 4,4'-sec-isooctylidenediphenol, 4-t-octylphenol, 4,4'-sec-butylidenediphenol, 4-p-methylphenylphenol, 4,4'-isopentylidenediphenol, 4,4'-methylcyclohexylidenediphenol, 4,4'-dihydroxydiphenyl sulfide, 1,4-bis(4'-hydroxycumyl)benzene, 1,3-bis (4'-hydroxycumyl)benzene, 4,4'-thiobis(6-t-butyl-3-methylphenol), 4,4'-dihydroxydiphenylsulfone, hydroquinone monobenzyl ether, 4-hydroxybenzophenone, 2,4dihydroxybenzphenone, polyvinylbenzyloxycarbonylphenol, 2,4,4'-trihydroxybenzophenone, 2,2',4,4'-tetrahydroxybenzophenone, dimethyl 4-hydroxyphthalate, methyl 4hydroxybenzoate, 2,4,4'-trihydroxydiphenylsulfone, 1,5-bis-p-hydroxyphenylpentane, 1,6-bis-p-hydroxyphenoxyhexane, tolyl 4-hydroxybenzoate, α-phenylbenzyl 4-hydroxybenzoate, phenylpropyl 4-hydroxybenzoate, phenethyl 4-hydroxybenzoate, p-chlorobenzyl 4-hydroxybenzoate, p-methoxybenzyl 4-hydroxybenzoate, benzyl 4-hydroxybenzoate, m-chlorobenzyl 4-hydroxybenzoate, β-phenethyl 4-hydroxybenzoate, 4-hydroxy-2',4'-dimethyldiphenylsulfone, β-phenethyl orsellinate, cinnamyl orsellinate, o-chlorophenoxyethyl orsellinate, o-ethylphenoxyethyl orsellinate, o-phenylphenoxyethyl orsellinate, m-phenylphenoxyethyl orsellinate, β-3'-t-butyl-4'-hydroxyphenoxyethyl 2,4-dihydroxybenzoate, 1-t-butyl-4-p-hydroxyphenylsulfonyloxybenzene, 4-N-benzylsulfamoylphenol, p-methylbenzyl 2,4-dihydroxybenzoate, β-phenoxyethyl 2,4-dihydroxybenzoate, benzyl 2,4-dihydroxy-6-methylbenzoate, methyl bis-4-hydroxyphenylacetate, ditolylthiourea, and 4,4'-diacetyldiphenylthiourea; aromatic carboxylic acid derivatives, e.g., 3-phenylsalicylic acid, 3-cyclohexylsalicylic acid, 3,5-di-t-butylsalicyclic acid, 3,5-didodecylsalicylic acid, 3-methyl-5-benzylsalicylic acid, 3-phenyl-5-(α,α-dimethylbenzyl)salicylic acid, 2-phenyl-5-(α,α-dimethylbenzyl)salicylic acid, 3,5-di(α-methylbenzyl)salicylic acid, 5-t-octylsalicylic acid, 3,5-di-t-butylsalicylic acid, 3-chloro-5-cumylsalicylic acid, 3-methyl-5-t-octylsalicylic acid, 3-methyl-5-α-methylbenzylsalicylic acid, 3-methyl-5-cumylsalicylic acid, 3,5-di-t-amylsalicylic acid, 3-phenyl-5-benzylsalicylic acid, 3-phenyl-5-t-octylsalicyclic acid, 3-phenyl-5-α-methylbenzylsalicylic acid, 3,5-di-t-octylsalicylic acid, 3,5-bis (α-methylbenzyl)salicylic acid, 3,5-dicumylsalicylic acid, 4-methyl-5-(α-methylbenzyl)salicylic acid, 4-methyl-5-cumylsalicyclic acid, 3-(α-methylbenzyl)-6methylsalicylic acid, 3-(α-methylbenzyl)-6-phenylsalicylic acid, 3-triphenylmethylsalicylic acid, 3-diphenylmethylsalicylic acid, 4-n-dodecylsalicylic acid, 4-t-dodecylsalicylic acid, 4-n-pentadecylsalicylic acid, 4-n-heptadecylsalicylic acid, 5-(1,3-diphenylbutyl)salicylic acid, 5-n-octadecylsalicylic acid, 5-dodecylsulfonylsalicylic acid, 5-dodecylsulfosalicylic acid, 3-methyl-5-dodecylsulfosalicylic acid, and 3,5-dicyclopentadienylsalicylic acid; phenolic resins, e.g., a p-phenylphenol-formalin resin, a p-butylphenol-acetone resin, etc.; and salts of these organic color developers with polyvalent metals, e.g., zinc, magnesium, aluminum, calcium, titanium, manganese, tin, nickel, etc. Examples of inorganic color developers which can also be used in the present invention are inorganic acids, such as hydrohalogenic acids (e.g., hydrochloric acid, hydrobromic acid, and hydroiodic acid), boric acid, silicic acid, phosphoric acid, sulfuric acid, nitric acid, perchloric acid, and halides of aluminum, zinc, nickel, tin, titanium or boron; acid clay, active clay, attapulgite, bentonite, colloidal silica, aluminum silicate, magnesium silicate, zinc silicate, tin silicate, zinc rhodanide, zinc chloride, iron stearate, cobalt naphthenate, nickel peroxide, ammonium sulfate, etc. In addition, aliphatic carboxylic acids, e.g., oxalic acid, maleic acid, tartaric acid, citric acid, succinic acid, stearic acid, etc., benzoic acid, p-t-butylbenzoic acid, phthalic acid, gallic acid, etc., may also be used in combination.

In the recording materials according to the present invention, the color developers are preferably used in a total amount of from about 50 to about 800%, and more preferably from 100 to 500%, by weight based on the amount of the color formers. It is preferred to use the aforesaid known color developers in an amount of from about 10 to about 2,000% by weight based on the salicylic acid or naphthoic acid derivatives of formulae (I) to (VI) according to the present invention.

Color formers which can be used in the present invention include triphenylmethanephthalide compounds, fluoran compounds, phenothiazine compounds, indolylphthalide compounds, Leuco Auramine compounds, Rhodamine lactam compounds, triphenylmethane compounds, triazene compounds, spiropyran compounds, and the like.

Examples of the phthalide color formers are described in U.S. Pat. Nos. Re. 23,024 3,491,111, 3,491,112, 3,491,116 and 3,509,174. Examples of fluoran compounds are described in U.S. Pat. Nos. 3,624,107, 3,627,787, 3,641,011, 3,462,828, 3,681,390, 3,681,390, 3,920,510, and 3,959,571. Examples of the spiropyran compounds are described in U.S. Pat. No. 3,971,808. Examples of pyridine and pyrazine color formers are described in U.S. Pat. Nos. 3,775,424, 3,853,869 and 4,246,318. Representative examples of these color formers are triarylmethane compounds, e.g., 3,3-bis(p-dimethylaminophenyl)-6-dimethylaminophthalide (Crystal Violet Lactone), 3,3-bis(p-dimethylaminophenyl)phthalide, 3-(p-dimethylaminophenyl)-3-(1,3-dimethylindol-3-yl) phthalide, 3-(p-dimethylaminophenyl)-3-(2-methyl-indol-3-yl) phthalide, etc.; diphenylmethane compounds, e.g., 4,4'-bisdimethylaminobenzhydrin benzyl ether, an N-halophenyl-Leuco Auramine, N-2,4,5-trichlorophenyl-Leuco Auramine, etc.; xanthene compounds, e.g., Rhodamine B-anilinolactam, 3-diethylamino-7,8-benzofluoran, Rhodamine (p-nitroanilino)lactam, Rhodamine B (p-chloroanilino)lactam, 2-dibenzylaminofluoran, 2-dibenzylamino-6-diethylaminofluoran, 2-anilino-6-diethylaminofluoran, 2-anilino-3-methyl-6-diethylaminofluoran, 2-anilino-3-methyl-6-cyclohexylmethylaminofluoran, 2-anilino-3-methyl-6-piperidinofluoran, 2-o-chloroanilino-6-diethylaminofluoran, 2-m-chloroanilino-6-diethylaminofluoran, 2-(3,4-dichloroanilino)-6-diethylaminofluoran, 2-octylamino-6-diethylaminofluoran, 2-dihexylamino-6-diethylaminofluoran, 2-m-trifluoromethylanilino-6-diethylaminofluoran, 2-butylamino-3-chloro-6-diethylaminofluoran, 2-ethoxyethylamino-3-chloro-6-diethylaminofluoran, 2-p-chloroanilino-3-methyl-6-dibutylaminofluoran, 2-anilino-3-methyl-6-dioctylaminofluoran, 2-anilino-3-chloro-6-diethylaminofluoran, 2-diphenylamino-6-diethylaminofluoran, 2-anilino-3-methyl-6-diphenylaminofluoran, 2-phenyl-6-diethylaminofluoran, 2-phenylamino-6-diethylaminofluoran, 2-anilino-3-methyl-6-N-ethyl-N-isoamylaminofluoran, 2-anilino-3-methyl-5-chloro-6-diethylaminofluoran, 2-anilino-3-methyl-6-diethylamino-7-methylfluoran, 2-anilino-3-methoxy-6-dibutylaminofluoran, 2-o-chloroanilino-6-dibutylaminofluoran, 2-p-chloroanilino-3-ethoxy-6-N-ethyl-N-isoamylaminofluoran, 2-o-chloroanilino-6-p-butylanilinofluoran, 2-anilino-3-pentadecyl-6-diethylaminofluoran, 2-anilino-3-ethyl-6-dibutylaminofluoran, 2-anilino-3-methyl-4',5'-dichlorofluoran, 2-o-toluidino-3-methyl-6-diisopropylamino-4', 5'-dimethylaminofluoran, 2-anilino-3-ethyl-6-N-ethyl-N-isoamylaminofluoran, 2-anilino-3-methyl-6-N-ethyl-N-Y-methoxypropylaminofluoran, 2-anilino-3-chloro-6-N-ethyl-N-isoamylaminofluoran, 2-anilino-3-methyl-6-dimethylaminofluoran, 2-anilino-3-methyl-6-N-methyl-N-ethylaminofluoran, 2-anilino-3-methyl-6-N-methyl-N-(isopropyl) aminofluoran, 2-anilino-3-methyl-6-N-methyl-N-pentylaminofluoran, 2-anilino-3-methyl-6-N-methyl-N-cyclohexylaminofluoran, 2-anilino-3-chloro-6-dimethylaminofluoran, 2-anilino-3-methyl-6-N-methyl-N-isoamylaminofluoran, 2-anilino-3-chloro-6-N-methyl-N-ethylaminofluoran, 2-anilino-3-chloro-6-N-methyl-N-(isopropyl)aminofluoran, 2-anilino-3-chloro-6-N-methyl-N-pentylaminofluoran, 2-anilino-3-chloro-6-N-methyl-N-cyclohexylaminofluoran, 2-anilino-3-methyl-6-N-ethyl-N-pentylaminofluoran, 2-anilino-3-chloro-6-N-pentylaminofluoran, 2-(p-methylanilino)-3-methyl-6-dimethylaminofluoran, 2-(p-methylanilino)-3-methyl-6-diethylaminofluoran, 2-(p-methylanilino)-3-methyl-6-N-methyl-N-ethylaminofluoran, 2-(p-methylanilino)-3-methyl-6-N-methyl-N-(isopropyl) aminofluoran, 2-(p-methylanilino)-3-methyl-6-N-methyl-N-pentylaminofluoran, 2-(p-methylanilino)-3-methyl-6-N-methyl-N-cyclohexylaminofluoran, 2-(p-methylanilino)-3-methyl-6-N-ethyl-N-pentylaminofluoran, 2-(p-methylanilino)-3-chloro-6-dimethylaminofluoran, 2-(p-methylanilino)-3-chloro-6-diethylaminofluoran, 2-(p-methylanilino)-3-chloro-6-N-methyl-N-ethylaminofluoran, 2- (p-methylanilino)-3-chloro-6-N-methyl-N-(isopropyl)-aminofluoran, 2-(p-methylanilino)-3-chloro-6-N-methyl-N-cyclohexylaminofluoran, 2-(p-methylanilino)-3-chloro-6-N-methyl-N-pentylaminofluoran, 2-(p-methylanilino)-3-chloro-6-N-ethyl-N-pentylaminofluoran, 2-anilino-3-methyl-6-N-methyl-N-furylmethylaminofluoran, 2-anilino-3-ethyl-6-N-methyl-N-furylmethylaminofluoran, etc.; thiazine compounds, e.g., benzoyl Leucomethylene Blue, p-nitrobenzoyl Leucomethylene Blue, etc.; spiro compounds, e.g., 3-methyl-spiro-dinaphthopyran, 3-ethyl-spirodinaphthopyran, 3,3'-dichloro-spirodinaphthopyran, 3-benzyl-spiro-dinaphthopyran, 3-methyl-naphtho-(3-methoxybenzo)-spiropyran, 3-propyl-spiro-dibenzopyran, 3-phenyl-7-dibenzylamino-2,2'-spiro-di[2H-1-benzopyran], 3,3-bis(4-dimethylaminophenyl)-6-dimethylaminophthalide, etc.; indolylphthalides, e.g., 3,3-bis(1-ethyl-2-methylindol-3-yl) phthalide, 3,3-bis(1-octyl-2-methylindol-3yl)phthalide, 3-(ethoxy-4-diethylaminophenyl)-3-(1-ethyl-2-methylindol-3-yl) phthalide, 3-(2-ethoxy-4-dibutylaminophenyl)-3-(1-ethyl-2-methylindol-3-yl)-phthalide. 3-(2-amyloxy-4-diethylaminophenyl)-3-(1-ethyl-2-methylindol-3-yl) phthalide, 3-(2-ethoxy-4-diethylaminophenyl)-3-(1-octyl-2-methylindol-3-yl)-phthalide, etc.; pyridine compounds, e.g., 3-(2-ethoxy-4-diethylaminophenyl)-3-(1-octyl-2-methylindol-3-yl)-4-or 7-azaphthalide, 3-(2-ethoxy-4-diethylaminophenyl)-3-(1-ethyl-2-methylindol-3-yl)-4- or 7-azaphthalide, 3-(2-hexyloxy-4-diethylaminophenyl)-3-(1-ethyl-2-methylindol-3-yl)-4- or 7-azaphthalide, 3-(2-ethoxy-4-diethylaminophenyl)-3-(1-ethyl-2-phenylindol-3-yl)-4- or 7-azaphthalide, 3-(2-butoxy-4-diethylaminophenyl)-3-(1-ethyl-2-phenylindol-3-yl)-4- or 7-azaphthalide, 3-(2-ethoxy-4-diethylaminophenyl)-3-(1-octyl-2-phenylindol-3-yl)-4- or 7-azaphthalide, etc.; and fluorene compounds, 3',6'-bisdiethylamino-5-diethylaminospiro-(isobenzofuran-1,9'-fluoren)-3-one, 3',6'-bisdiethylamino-7-diethylamino-2-methylspiro(1,3-benzoxazine-4,9'fluorene), 3',6'-bisdiethylamino-7-diethylaminospiro(2-hydro-1,3-benzoxazine-4,9'-fluoren)-2-one, etc.

Preferred among the above-described color formers are triarylmethane compounds (e.g., Crystal Violet Lactone) and xanthene compounds because of less generation of fog and their ability to provide high color density. Even more preferred are xanthene compounds represented by formula (VII):

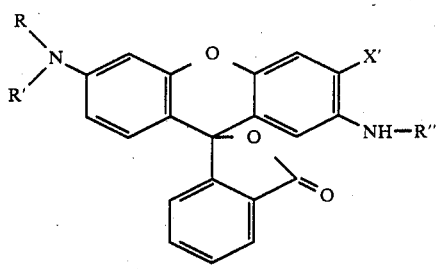

(VII)

wherein R and R' each represents a substituted or unsubstituted, straight or branched chain or cyclic alkyl group preferably having from 1 to 10 carbon atoms, or R and R' join together to form a 5- to 7-membered heterocyclic ring; R'' represents an aryl group, preferably having from 6 to 20 carbon atoms, and R'' more preferably represents a substituted or unsubstituted phenyl group, wherein the substituent preferably includes an alkyl group having from 1 to 10 carbon atoms; and X' represents an alkyl group, preferably having from 1 to 10 carbon atoms, or a halogen atom.

The above-described known color formers may be used either individually or, for the purpose of tone control and discoloration inhibition, in combinations of two or more.

Methods for producing the recording materials according to the present invention, as well as various useful additives therefor, are described below referring to particular forms of recording materials.

The heat-sensitive recording materials to which the present invention may be applied include various embodiments as described in West German Patent Application (OLS) Nos. 2,228,581 and 2,110,854 and Japanese Patent Publication No. 20142/77. In the production of the heat-sensitive recording materials, each of the color former and the color developer is finely dispersed in a dispersing medium to a particle size of not more than about 10 μm, and preferably not more than 3 μm by means of a ball mill, a sand mill, a horizontal sand mill, an attritor, a colloid mill, etc. Generally employed dispersing media are aqueous solutions of water-soluble high molecular weight polymers in concentrations of from about 0.5 to about 10% by weight.

A weight ratio of the color former to the color developer to be used preferably ranges from about 1:10 to about 1:1, and more preferably from 1:5 to 2:3.

It is preferred that a heat-sensitive recording layer further contains a heat-fusible substance in order to improve thermal response properties. Preferred heat-fusible substances include those represented by the following formulae (VIII) to (XIII):

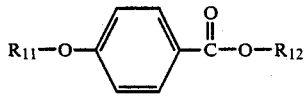

(VIII)

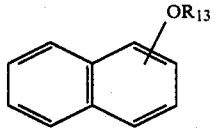

(IX)

-continued

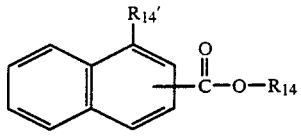

(X)

$R_{15}NHCONH_2$ (XI)

$R_{16}CONH—R_{17}$ (XII)

wherein $R_{11}$, $R_{12}$, $R_{13}$, and $R_{14}$ each represents a phenyl group, a benzyl group, which may be substituted with a lower alkyl group having from 1 to 8 carbon atoms, preferably from 1 to 3 carbon atoms, or which may be substituted with a halogen atom, preferably a fluorine atom; $R_{15}$ and $R_{16}$ each represents an alkyl group having from 12 to 24 carbon atoms; $R_{17}$ represents a hydrogen atom or a phenyl group; and $R_{14}$, represents a hydrogen atom or a hydroxyl group;

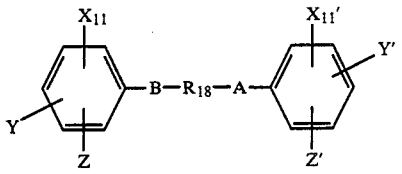

(XIII)

wherein $R_{18}$ represents a divalent group, preferably an alkylene group, an alkylene group having a carbonyl group, an alkylene group having a halogen atom or an alkylene group having an unsaturated bond, and more preferably an alkylene group or an alkylene group having an ether linkage; $X_{11}$, Y, Z, $X_{11}'$, Y', and Z', which may be the same or different, each represents a hydrogen atom, a halogen atom, an alkyloxycarbonyl group or an aralkyloxycarbonyl group; and A and B, which may be the same or different, each represents an oxygen atom or a sulfur atom.

The compounds represented by formulae (VIII) to (XIII) preferably have a melting point of from about 70° to about 150° C., and more preferably from 80° to 130° C.

Specific examples of these heat-fusible substances are benzyl p-benzyloxybenzoate (m.p.=119° C.), β-naphthyl benzyl ether (m.p. =105° C.), stearamide (m.p.=108° C.), palmitamide (m.p.=103° C.), N-phenylstearamide (m.p.=96° C.), N-benzylphenylacetic amide (m.p.=122° C.), N-stearylurea (m.p.=110° C.), phenyl β-naphthoate (m.p.=92° C.), phenyl 1-hydroxy-2-naphthoate (m.p.=92° C.), β-naphthol p-chlorobenzyl ether (m.p.=115° C.), β-naphthol p-methylbenzyl ether (m.p.=96° C.), α-naphthyl benzyl ether (m.p.=76° C.), 1,4-butanediol p-methylphenyl ether (m.p.=93° C.), 1,4-propanediol p-methylphenyl ether (m.p.=93° C.), 1,4-butanediol p-isopropylphenyl ether (m.p.=79° C.), 1,4-butanediol p-t-octylphenyl ether (m.p.=99° C.), 2-phenoxy-1-p-tolyloxyethane (m.p.=104° C.), 1-phenoxy-2-(4-ethylphenoxy)ethane (m.p.=106° C.), 1-phenoxy-2-(4-chlorophenoxy)ethane (m.p.=77° C.), 1,4-butanediol phenyl ether (m.p.=98° C.), and diethylene glycol bis(4-methoxyphenyl)ether (m.p.=101° C.).

The heat-fusible substances may be used either individually or in combination. In order to obtain sufficient thermal response sensitivity, the heat-fusible substance is preferably used in an amount of from about 10 to about 200%, more preferably from 20 to 150%, by weight based on the amount of the color developer.

The heat-sensitive recording layer contains a water-soluble binder. Suitable binders include compounds having a solubility of at least 5% by weight in water at 25° C. Specific examples of the binder are polyvinyl alcohol, methyl cellulose, carboxymethyl cellulose, hydroxyethyl cellulose, starches (inclusive of modified starch), gelatin, gum arabic, casein, styrene-maleic anhydride copolymer hydrolysis products, ethylene-maleic anhydride copolymer hydrolysis products, isobutylene-maleic anhydride copolymer hydrolysis products, carboxy-modified polyvinyl alcohol, polyacrylamide, vinyl acetate-polyacrylic acid copolymer saponification products, etc. These binders may also serve as a medium into which the color former, color developer, and heat-fusible substance may be dispersed.

If desired, the heat-sensitive recording layer can further contain pigments, water-insoluble binders, metallic soaps, waxes, surface active agents, and the like.

Suitable pigments include calcium carbonate, barium sulfate, lithopone, talc, agalmatolite, kaolin, silica, amorphous silica, etc. Preferred pigments include precipitated calcium carbonate, kaolin, surface-treated amorphous silica, and aluminum hydroxide.

Suitable water-insoluble binders include synthetic rubber latices and synthetic resin emulsions such as a styrene-butadiene rubber latex, an acrylonitrile-butadiene rubber latex, a methyl acrylate-butadiene rubber latex, a vinyl acetate emulsion, etc. In order to prevent fog, it is desirable that the amount of a surface active agent to be added to the rubber latex or emulsion be as small as possible, and a so-called soap-free rubber latex or emulsion is preferred.

Suitable metallic soaps include higher fatty acid metal salts. Emulsions of zinc stearate, calcium stearate, aluminum stearate, and the like are usually employed.

Suitable waxes include emulsions of paraffin wax, microcrystalline wax, carnauba wax, methylolstearamide, a polyethylene wax, a polystyrene wax, etc.

Suitable surface active agents include alkali metal salts of sulfosuccinic acid compounds and fluorine-containing surface active agents.

For the purpose of ensuring fastness of recorded color images, it is preferred to incorporate a discoloration inhibitor that prevents color image fading into the heat-sensitive recording layer.

Suitable discoloration inhibitors include phenol derivatives, and particularly hindered phenol compounds. Preferred discoloration inhibitors are represented by the following formulae (XIV) to (XVII):

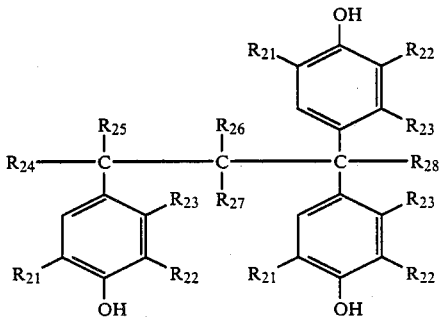

(XIV)

wherein $R_{21}$ represents a branched alkyl group having from 3 to 8 carbon atoms; $R_{22}$ represents a hydrogen atom or a branched alkyl group having from 3 to 8 carbon atoms; $R_{23}$ represents a hydrogen atom or an alkyl group having from 1 to 3 carbon atoms; $R_{24}$ represents a hydrogen atom or an alkyl group having from 1 to 8 carbon atoms; $R_{25}$, $R_{26}$ and $R_{27}$ each represents a hydrogen atom or an alkyl group having from 1 to 3 carbon atoms; and $R_{28}$ represents an alkyl group having from 1 to 8 carbon atoms;

(XV)

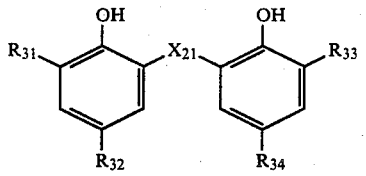

wherein $R_{31}$ and $R_{33}$ each represents a branched alkyl group having from 3 to 8 carbon atoms; $R_{32}$ and $R_{34}$ each represents an alkyl group having from 1 to 8 carbon atoms; $X_{21}$ represents S, O, $SO_2$, $S_2$,

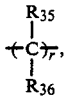

a cyclopentylene group or a cyclohexylene group; r represents 0 or an integer of from 1 to 3; and $R_{35}$ and $R_{36}$ each represents a hydrogen atom or an alkyl group having from 1 to 8 carbon atoms;

(XVI)

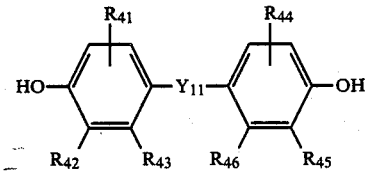

wherein $R_{41}$ and $R_{44}$ each represents a branched alkyl group having from 3 to 8 carbon atoms; $R_{42}$, $R_{43}$, $R_{45}$, and $R_{46}$ each represents a hydrogen atom or an alkyl group having from 1 to 8 carbon atoms; $Y_{11}$ represents S, O, $SO_2$, $S_2$, or

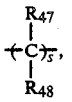

wherein s represents 0 or an integer of from 1 to 3; and $R_{47}$ and $R_{48}$ each represents a hydrogen atom or an alkyl group having from 1 to 8 carbon atoms, or $R_{47}$ and $R_{48}$ may be joined together to form a cyclic pentamethylene group;

(XVII)

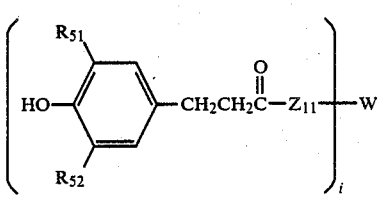

wherein $R_{51}$ and $R_{52}$ each represents a branched alkyl group having from 3 to 8 carbon atoms; $Z_{11}$ represents —NH—, —O$(CH_2)_t$—, wherein t represents an integer of from 1 to 5; i represents an integer of from 1 to 4; when i=1, W represents an alkyl group having from 1 to 18 carbon atoms; when i=2, W represents S, O,

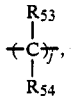

wherein $R_{53}$ and $R_{54}$ each represents a hydrogen atom or an alkyl group having from 1 to 8 carbon atoms, and j represents 0 or an integer of from 1 to 8; when i=3, W represents →C—$R_{55}$, wherein $R_{55}$ represents a hydrogen atom or an alkyl group having from 1 to 8 carbon atoms; when i=4, W represents

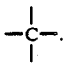

Typical examples of the phenol derivatives represented by formulae (XIV) to (XVII) are as follows.

(A) Specific examples of the phenol derivatives represented by formula (XIV) are 1,1,3-tris(2-methyl-4-hydroxy-5-tert-butylphenyl) butane, 1,1,3-tris-(2-ethyl-4-hydroxy-5-tert-butylphenyl) butane, 1,1,3-tris(3,5-di-tert-butyl-4-hydroxyphenyl) butane, 1,1,3-tris(2-methyl-4-hydroxy-5-tert-butylphenyl) propane, etc.

(B) Specific examples of the phenol derivatives represented by formula (XV) are 2,2'-methylene-bis-(6-tert-butyl-4-methylphenol), 2,2'-methylene-bis(6-tertbutyl-4-ethylphenol), etc.

(C) Specific examples of the phenol derivatives represented by formula (XVI) are 4,4'-butylidene-bis (6-tert-butyl-3-methylphenol), 4,4,-thio-bis(3-methyl-6-tert-butylphenol), etc.

(D) Specific examples of the phenol derivatives represented by formula (XVII) are the following compounds:

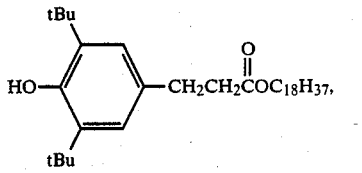

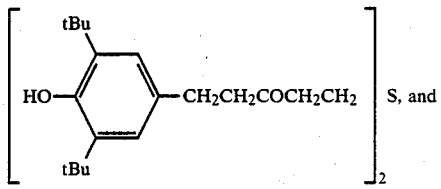

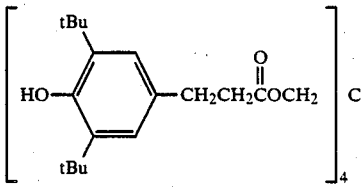

The phenol compounds represented by formulae (XIv) to (XVII) are preferably used in an amount of from about 1 to about 200%, more preferably from 5 to 50%, by weight based on the amount of the color developer.

The above-described components are dispersed into the aforesaid water-soluble binder to prepare a coating composition. The coating composition is applied to a support, such as base paper, fine paper, synthetic paper, a plastic sheet, and neutral paper, to a dry coverage of from about 2 to about 10 g/m$^2$.

Durability of the heat-sensitive recording material may be improved by providing a protective layer comprising a water-soluble or water-dispersible polymeric compound, such as polyvinyl alcohol, hydroxyethyl starch, or epoxy-modified polyacrylamide, and a cross-linking agent to a thickness of from about 0.2 to about 2 μm.

The heat-sensitive recording materials can be subjected to preheating, moisture conditioning, stretching, and the like prior to image recording.

The present invention will now be illustrated in greater detail by way of the following examples and comparative examples, but it should be understood that the present invention should not be construed as being limited in any manner by these examples. In these examples, all parts, percents, ratios and the like are by weight unless otherwise indicated.

In evaluations of heat response properties, a test chart No. 3 of Gazo Denshi Gakkai (The Institute of Image Electronics) was copied on heat-sensitive materials by means of a high speed facsimile "FF-2000" manufactured by Fujitsu Ltd., and the image density was measured by the use of a Macbeth densitometer "RD-918".

EXAMPLE 1 AND COMPARATIVE EXAMPLE 1

The salicylic acid derivative color developers and the metal compounds shown in Table 1 were mixed at the mixing ratios shown in Table 1 to prepare Mixtures (1) to (15) according to the present invention. For comparison, Mixtures (16) to (20) were prepared in the same manner, but using a color developer outside the scope of the present invention, as shown in Table 1.

Combinations of color formers, Mixtures (1) to (15), color developers, heat-fusible substances, discoloration inhibitors, and pigments used for sample preparation are shown in Table 2. 20 g each of the materials shown in Table 2 were poured into 100 g of a 5% polyvinyl alcohol ("PVA-105", a trade name, manufactured by Kuraray Co., Ltd.) aqueous solution while stirring and, after thoroughly defoaming, dispersed by means of a sand mill ("Dynomill KDL", a trade name, manufactured by WEB Company) to a volume average particle size of 3 μm or smaller. 80 g of the pigments shown in Table 2 were dispersed by means of a homogenizer together with 160 g of a 0.5% aqueous solution of sodium hexametaphosphate. Further, a 21% dispersion of zinc stearate was prepared.

The thus-prepared dispersions were mixed at the mixing ratios shown in Table 3. The resulting coating composition was coated on fine paper having a basis weight of 50 g/m$^2$ with a wire bar to a dry coverage of 7 g/m$^2$, and dried in an oven at 50° C. to obtain a heat-sensitive recording material. The resulting heat-sensitive recording materials were designated as Samples 101 to 118.

For comparison, Samples A to E were prepared in the same manner as above, except for using each of Mixtures (16) to (20). The mixing ratios of the dispersions are shown in Table 3. Further, Samples F to N were prepared in the same manner as Samples 106 to 114, except for excluding the metal compound from Mixtures respectively). The mixing ratios of the dispersions are also shown in Table 3.

Each of Samples 101 to 118 and A to N was kept at 60° C. and 30% RH (Condition I) or at 40° C. and 90% RH (Condition II) for 24 hours, and the sample was evaluated for fog on the white background and heat response properties (density of the color developed area) either before or after being stored under Condition I or II, as well as being evaluated as to preservability of color images. The preservability of color images was determined by the percentage of color retention obtained by the equation:

$$\text{Color Retention (\%)} = \frac{\text{(Density after Preservation)}}{\text{(Density Immediately after Color Formation)}} \times 100$$

The results obtained are shown in Table 4 below.

TABLE 1

| Mixture No. | Color Developer (a) | Metal Compound (b) | (b)/(a) Mixing Ratio Molar Ratio |
|---|---|---|---|
| (1) | 4-β-phenoxyethoxy-salicylic acid | zinc oxide | 6.77 |
| (2) | 4-β-p-tolyloxyethoxy-salicylic acid | magnesium oxide | 3.60 |
| (3) | 4-β-p-methoxyphenoxy-ethoxysalicylic acid | zinc oxide | 3.75 |
| (4) | 4-β-p-ethylphenoxy-ethoxysalicylic acid | zinc carbonate | 1.20 |
| (5) | 4-β-p-ethoxyphenoxy-ethoxysalicylic acid | zinc hydroxide | 0.28 |
| (6) | 4-(8-phenoxyoctyloxy)-. salicylic acid | zinc carbonate | 1.43 |
| (7) | 4-(4-p-t-butylphenoxy-butyloxy)salicylic acid | zinc sulfide | 1.70 |
| (8) | 4-β-p-benzyloxy-carbonylphenoxyethoxy-salicylic acid | aluminum oxide | 2.00 |
| (9) | 4-β-p-methoxyphenoxy-ethoxysalicylic acid | zinc carbonate | 0.15 |
| (10) | 4-β-p-methylphenoxy-ethoxysalicylic acid | zinc oxide | 1.13 |
| (11) | 4-β-p-methoxyphenoxy-ethoxysalicylic acid | zinc oxide | 1.88 |
| (12) | 1-hydroxy-4-β-phenoxy-ethoxy(2)naphthoic acid | zinc oxide | 3.50 |
| (13) | 5-phenylacetylamino-salicylic acid | zinc oxide | 3.50 |
| (14) | 3,5-bis(p-tolyloxy-methyl)salicylic acid | zinc oxide | 3.50 |
| (15) | 5-myristoylsalicylic acid | zinc oxide | 3.50 |
| (16) | 2,2-bis(p-hydroxy-phenyl)propane | zinc oxide | 6.77 |
| (17) | 1,1'-bis(4'-hydroxy-phenyl)cyclopropane | magnesium oxide | 3.60 |
| (18) | benzyl 4-hydroxy-benzoate | zinc oxide | 3.75 |
| (19) | dimethyl 3-hydroxy-o-phthalate | zinc carbonate | 1.20 |
| (20) | 3,5-di-t-butyl-salicylic acid | zinc hydroxide | 0.28 |

TABLE 2

| Sample No. | Color Former | Mixture No. | Color Developer | Heat-Fusible Substance | Discoloration Inhibitor | Pigment |
|---|---|---|---|---|---|---|
| 101 | Crystal Violet Lactone | (1) | none | β-naphthyl benzyl ether | 1,1,3-tris(2-methyl-4-hydroxy-5-t-butylphenyl)-butane | calcium carbonate |
| 102 | 2-anilino-3-chloro-diethylaminofluoran | (2) | none | β-naphthyl benzyl ether | none | calcium carbonate |
| 103 | 1:1 (by weight) mixture of 2-anilino-3-chloro-6-diethylaminofluoran and 2-anilino-3-methyl-6-N-methyl-N-cyclohexylamino-fluoran | (3) | none | β-naphthyl benzyl ether | none | calcium carbonate |
| 104 | 1:1 (by weight) mixture of 2-anilino-3-chloro-6-diethylaminofluoran and 2-anilino-3-methyl-6-N-ethyl-N-isoamylamino-fluoran | (4) | none | β-naphthyl benzyl ether | none | calcium carbonate |
| 105 | 1:1 (by weight) mixture of 2-anilino-3-chloro-6-diethylaminofluoran and 2-anilino-3-methyl-6-N-ethyl-N-furylmethyl-aminofluoran | (5) | none | β-naphthyl benzyl ether | none | calcium carbonate |
| 106 | 1:1 (by weight) mixture of 2-anilino-3-chloro-6-diethylaminofluoran and 2-anilino-3-methyl-6-N-ethyl-N-isoamlamino-fluoran | (6) | 2,2-bis(p-hydroxyphenyl)-propane | β-naphthyl benzyl ether | 1,1,3-tris(2-methyl-4-hydroxy-5-t butylphenyl)-butane | 1:1 mixture of calcium carbonate and amorphous silica |
| 107 | 2-anilino-3-methyl-6-N-ethyl-N-isoamylamino-fluoran | (7) | 1,1-bis(4'-hydroxyphenyl)-cyclohexane | 1-phenoxy-2-(4-ethylphenoxy)-ethane | 1,1,3-tris(2-methyl-4-hydroxy-5-t-butylphenyl)-butane | calcium carbonate |
| 108 | 2-anilino-3-methyl-6-N-ethyl-N-isoamylamino-fluoran | (8) | benzyl 4-hydroxybenzoate | phenyl 1-hydroxy-2-naphthoate | 2,2'methylene-bis(6-t-butyl-4-methylphenol) | calcium carbonate |
| 109 | 2-anilino-3-methyl-6-diethylaminofluoran | (9) | none | diethylene glycol bis(4-methoxy-phenyl) ether | 4,4'thio-bis-(3-methyl-6-t-butylphenol) | calcined kaolin |
| 110 | 2-anilino-3-methyl-6-diethylaminofluoran | (10) | none | β-naphthyl benzyl ether | 1,1,3-tris(2-methyl-4-hydroxy-5-t-butylphenyl)-butane | 1:1 mixture of calcium carbonate and amorphous silica |
| 111 | 1:1 (by weight) mixutre of 2-anilino-3-chloro-6-diethylaminofluoran and2-anilino-3-methyl-6-N-methyl-N-cyclohexylaminofluoran | (11) | 1,4-bis(p-hydroxycumyl)-benzene | diethylene glycol bis(4-methoxy-phenyl) ether | none | 1:1 mixture of calcium carbonate and amorphous silica |
| 112 | 2-anilino-3-methyl-6-N-ethyl-N-tetrahydro-furfurylaminofluoran | (11) | none | N-benzylphenyl-acetic amide | none | calcium carbonate |
| 113 | 2-anilino-3-methyl-6-N-ethyl-N-tetrahydro-furfurylaminofluoran | (11) | none | diethylene glycol bis(4-methoxy-phenyl) ether | none | 1:1 mixture of calcium carbonate and amorphous silica |
| 114 | 2-anilino-3-methyl-6-diethylaminofluoran | (11) | none | 1-phenoxy-2-(4-ethylphenoxy) ethylphenoxy) ethane | none | amorphous silica |
| 115 | 1:1 (by weight) mixture of 2-anilino-3-chloro-6-diethylaminofluoran and 2-anilino-3-methyl-6-N-ethyl-N-isoamylamino-fluoran | (12) | none | 2-benzyloxy-naphthalene | none | calcium carbonate |
| 116 | 1:1 (by weight) mixture of 2-anilino-3-chloro-6-diethylaminofluoran and 2-anilino-3-methyl-6-N-ethyl-N-isoamylamino-fluoran | (13) | none naphthalene | 2-benzyloxy- | none carbonate | calcium |
| 117 | 1:1 (by weight) mixture of 2-anilino-3-chloro-6-diethylaminofluoran and 2-anilino-3-methyl-6-N-ethyl-N-isoamylamino- | (14) | none | 2-benzyloxy-naphthalene | none | calcium carbonate |

TABLE 2-continued

| Sample No. | Color Former | Mixture No. | Color Developer | Heat-Fusible Substance | Discoloration Inhibitor | Pigment |
|---|---|---|---|---|---|---|
| 118 | fluoran 1:1 (by weight) mixture of 2-anilino-3-chloro-6-diethylaminofluoran and 2-anilino-3-methyl-6-N-ethyl-N-isoamylamino-fluoran | (15) | none | 2-benzyloxy-naphthalene | none | calcium carbonate |

TABLE 3

| Sample No. | Weight Mixing Ratio of Dispersions | | | | | | |
|---|---|---|---|---|---|---|---|
| | Color Former Dispersion | Dispersion of Mixture | Color Developer Dispersion | Heat-Fusible Substance Dispersion | Discoloration Inhibitor Dispersion | Pigment Dispersion | Zinc Stearate Dispersion |
| 101 | 100 | (1): 600 | 0 | 200 | 60 | 480 | 40 |
| 102 | 100 | (2): 325 | 0 | 375 | 0 | 400 | 30 |
| 103 | 100 | (3): 600 | 0 | 600 | 0 | 650 | 50 |
| 104 | 100 | (4): 225 | 0 | 110 | 0 | 260 | 20 |
| 105 | 100 | (5): 275 | 0 | 250 | 0 | 400 | 25 |
| 106 | 100 | (6): 300 | 30 | 230 | 70 | 450 | 30 |
| 107 | 100 | (7): 300 | 75 | 330 | 100 | 580 | 40 |
| 108 | 100 | (8): 375 | 75 | 330 | 100 | 580 | 40 |
| 109 | 100 | (9): 220 | 0 | 170 | 30 | 300 | 20 |
| 110 | 100 | (10): 260 | 0 | 200 | 30 | 350 | 25 |
| 111 | 100 | (11): 300 | 60 | 260 | 40 | 450 | 30 |
| 112 | 100 | (11): 300 | 0 | 200 | 0 | 360 | 25 |
| 113 | 100 | (11): 450 | 0 | 450 | 0 | 500 | 40 |
| 114 | 100 | (11): 300 | 0 | 160 | 0 | 280 | 20 |
| 115 | 100 | (12): 400 | 0 | 200 | 0 | 360 | 25 |
| 116 | 100 | (13): 400 | 0 | 200 | 0 | 360 | 25 |
| 117 | 100 | (14): 400 | 0 | 200 | 0 | 360 | 25 |
| 118 | 100 | (15): 400 | 0 | 200 | 0 | 360 | 25 |
| A | 100 | (16): 680 | 0 | 200 | 60 | 520 | 40 |
| B | 100 | (17): 385 | 0 | 375 | 0 | 430 | 35 |
| C | 100 | (18): 700 | 0 | 600 | 0 | 700 | 55 |
| D | 100 | (19): 260 | 0 | 110 | 0 | 280 | 20 |
| E | 100 | (20): 280 | 0 | 250 | 0 | 400 | 25 |
| F | 100 | (6'): 200 | 30 | 230 | 70 | 375 | 25 |
| G | 100 | (7'): 200 | 60 | 260 | 80 | 420 | 30 |
| H | 100 | (8'): 250 | 75 | 325 | 100 | 500 | 35 |
| I | 100 | (9'): 200 | 0 | 170 | 30 | 300 | 20 |
| J | 100 | (10'): 200 | 0 | 200 | 30 | 320 | 20 |
| K | 100 | (11'): 200 | 60 | 260 | 40 | 400 | 25 |
| L | 100 | (11'): 200 | 0 | 200 | 0 | 300 | 20 |
| M | 100 | (11'): 300 | 0 | 450 | 0 | 420 | 35 |
| N | 100 | (11'): 200 | 0 | 160 | 0 | 230 | 20 |

TABLE 4

| Sample No. | Color Density | | | Background Fog (density) | | | Color Retention (%) | |
|---|---|---|---|---|---|---|---|---|
| | Before Testing | After Testing (I) | After Testing (II) | Before Testing | After Testing (I) | After Testing (II) | (I) | (II) |
| 101 | 1.12 | 1.11 | 1.12 | 0.07 | 0.10 | 0.06 | 99 | 100 |
| 102 | 1.23 | 1.24 | 1.23 | 0.05 | 0.09 | 0.06 | 101 | 100 |
| 103 | 1.24 | 1.25 | 1.25 | 0.06 | 0.08 | 0.05 | 101 | 101 |
| 104 | 1.23 | 1.23 | 1.23 | 0.07 | 0.09 | 0.08 | 100 | 100 |
| 105 | 1.25 | 1.26 | 1.26 | 0.05 | 0.08 | 0.07 | 101 | 101 |
| 106 | 1.33 | 1.35 | 1.34 | 0.05 | 0.11 | 0.10 | 102 | 101 |
| 107 | 1.32 | 1.34 | 1.33 | 0.08 | 0.10 | 0.11 | 102 | 101 |
| 108 | 1.35 | 1.37 | 1.36 | 0.08 | 0.11 | 0.12 | 101 | 101 |
| 109 | 1.30 | 1.28 | 1.29 | 0.09 | 0.08 | 0.09 | 98 | 99 |
| 110 | 1.26 | 1.25 | 1.25 | 0.05 | 0.09 | 0.10 | 99 | 99 |
| 111 | 1.25 | 1.25 | 1.26 | 0.05 | 0.10 | 0.10 | 100 | 101 |
| 112 | 1.28 | 1.26 | 1.27 | 0.05 | 0.09 | 0.09 | 98 | 99 |
| 113 | 1.24 | 1.25 | 1.25 | 0.05 | 0.08 | 0.08 | 101 | 101 |
| 114 | 1.25 | 1.26 | 1.26 | 0.06 | 0.08 | 0.09 | 101 | 101 |
| 115 | 1.18 | 1.16 | 1.16 | 0.07 | 0.08 | 0.07 | 100 | 100 |
| 116 | 1.10 | 1.08 | 1.08 | 0.05 | 0.06 | 0.08 | 97 | 95 |
| 117 | 1.20 | 1.20 | 1.20 | 0.06 | 0.09 | 0.08 | 100 | 100 |
| 118 | 1.23 | 1.23 | 1.23 | 0.09 | 0.12 | 0.12 | 101 | 100 |
| A | 1.25 | 1.24 | 1.23 | 0.08 | 0.11 | 0.09 | 99 | 98 |
| B | 1.28 | 1.10 | 1.08 | 0.07 | 0.08 | 0.09 | 86 | 94 |
| C | 1.35 | 0.95 | 0.89 | 0.06 | 0.12 | 0.11 | 70 | 66 |
| D | 1.32 | 0.87 | 0.75 | 0.08 | 0.09 | 0.10 | 66 | 57 |
| E | 1.10 | 1.22 | 1.25 | 0.12 | 0.25 | 0.23 | 111 | 114 |
| F | 1.31 | 1.25 | 1.22 | 0.05 | 0.11 | 0.10 | 95 | 93 |

TABLE 4-continued

| Sample No. | Color Density Before Testing | Color Density After Testing (I) | Color Density After Testing (II) | Background Fog (density) Before Testing | Background Fog (density) After Testing (I) | Background Fog (density) After Testing (II) | Color Retention (%) (I) | Color Retention (%) (II) |
|---|---|---|---|---|---|---|---|---|
| G | 1.34 | 1.30 | 1.29 | 0.08 | 0.10 | 0.11 | 97 | 96 |
| H | 1.38 | 1.30 | 1.33 | 0.08 | 0.11 | 0.12 | 94 | 96 |
| I | 1.32 | 1.30 | 1.29 | 0.09 | 0.08 | 0.09 | 98 | 98 |
| J | 1.28 | 1.25 | 1.24 | 0.06 | 0.08 | 0.09 | 98 | 97 |
| K | 1.27 | 1.26 | 1.25 | 0.05 | 0.09 | 0.10 | 99 | 98 |
| L | 1.26 | 1.24 | 1.24 | 0.05 | 0.09 | 0.09 | 98 | 98 |
| M | 1.26 | 1.25 | 1.24 | 0.05 | 0.08 | 0.08 | 99 | 98 |
| N | 1.26 | 1.25 | 1.25 | 0.05 | 0.08 | 0.09 | 98 | 99 |

Further, each of Samples 101 to 118 and A to N was evaluated for chemical resistance to a diazo developer, ethanol, castor oil, polyethylene glycol (PEG), and trioctyl phosphate (TOP). Filter papers impregnated with these chemicals were superimposed on the coated surface of each sample, and heat recording was carried out. Image quality was visually observed as to fog formation on the white background and color image fading (discoloration) of the color developed area, and was rated as follows.

The results obtained are shown in Table 5 below.

A: The change of image quality due to contact with chemicals is small or negligible.

B: The image is legible.

C: The image is illegible.

D: The image is seriously illegible.

TABLE 5

| Sample No. | Discoloration Diazo Developer | Discoloration Ethanol | Discoloration Castor Oil | Discoloration PEG | Discoloration TOP | Background Fog Diazo Developer | Background Fog Ethanol | Background Fog Castor Oil | Background Fog PEG | Background Fog TOP |
|---|---|---|---|---|---|---|---|---|---|---|
| 101 | C | B | C | B | C | B | B | B | B | B |
| 102 | B | B | B | B | B | B | B | B | B | B |
| 103 | A | A | A | A | A | A | A | A | A | A |
| 104 | B | B | B | B | B | B | B | B | B | B |
| 105 | B | B | B | B | B | B | B | B | B | B |
| 106 | A | A | A | A | A | C | C | C | C | C |
| 107 | A | A | A | A | A | C | C | B | B | B |
| 108 | A | A | A | A | A | C | C | C | C | C |
| 109 | A | A | A | A | A | A | A | A | A | A |
| 110 | A | A | A | A | A | A | A | A | A | A |
| 111 | B | B | B | B | A | B | A | B | B | B |
| 112 | A | A | A | A | A | A | A | A | A | A |
| 113 | A | A | A | A | A | A | A | A | A | A |
| 114 | A | A | A | A | A | A | A | A | A | A |
| 115 | B | A | A | B | A | B | B | B | B | A |
| 116 | A | A | A | B | A | A | B | B | B | B |
| 117 | B | A | A | B | A | A | B | B | B | A |
| 118 | B | B | B | B | B | B | B | B | B | B |
| A | B | C | D | D | D | D | D | D | D | C |
| B | C | C | D | D | D | D | D | D | D | C |
| C | D | C | D | D | D | D | D | D | D | C |
| D | D | C | D | D | D | D | D | D | D | C |
| E | A | C | D | D | D | D | D | D | D | C |
| F | C | C | C | C | C | C | C | C | C | C |
| G | C | C | C | C | D | C | C | B | B | B |
| H | C | C | C | C | D | C | C | C | C | C |
| I | C | C | C | C | D | A | A | A | A | A |
| J | C | C | C | D | C | A | A | A | A | A |
| K | D | B | D | B | D | B | A | B | B | B |
| L | C | C | C | C | C | A | A | A | A | A |
| M | C | C | C | C | C | A | A | A | A | A |
| N | C | C | C | C | C | A | A | A | A | A |

What is claimed is:

1. A heat-sensitive recording material comprising a support having thereon a recording layer containing an electron-donating colorless dye and an electron-accepting compound, wherein said electron-accepting compound is a salicylic acid derivative having an alkoxy group or an aryloxy group represented by formula (VII):

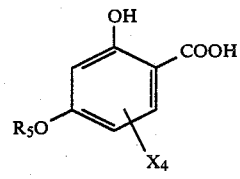

(VII)

wherein $R_5$ represents an alkyl group having from 6 to 20 carbon atoms or a group represented by formula $-(C_pH_{2p}-O)_q-Ar$ wherein Ar is a phenyl group, a phenyl group substituted with a 1-2 carbon alkoxy group or a phenyl group substituted with a 1-2 carbon alkyl group, p represents an integer of from 2 to 4 and q represents an integer of 1; and $X_4$ represents a hydrogen atom, said salicylic acid derivative containing at least 13 total carbon atoms and said recording layer further containing a zinc compound.

2. A heat-sensitive material as claim 1, wherein said zinc compound is present in an amount of from about 0.5 to about 10 mols per mol of said electron-accepting compound.

3. A heat-sensitive recording material as in claim 1, wherein said zinc compound is selected from oxides, hydroxides, aluminates, cyanides, hexacyanoferrates, sulfides, carbonates, phosphates, silicates, halides, halogen complex salts, sulfates, and nitrates of zinc.

4. A heat-sensitive recording material as in claim 1, wherein said zinc compound is selected from sparingly water-insoluble zinc compounds.

5. A heat-sensitive recording material as in claim 1, wherein said zinc compound is used in an amount of from 0.10 to 8 mols per mol of the electron-accepting compound.

6. A heat-sensitive recording material as in claim 1, wherein at least 80% by weight of said zinc compound is used in the form of a dispersion with said salicylic acid derivatives.

7. A heat-sensitive recording material as in claim 1, wherein said electron-accepting compounds are present in an amount of from about 50 to 800 wt % based on the amount of said electron-donating colorless dye.

8. A heat-sensitive recording material as in claim 1, wherein said recording layer further contains a heat-fusible substance having a melting point of from about 70° to about 150° C. in an amount of said electron-accepting compound.

* * * * *